United States Patent [19]

Vago

[11] 4,165,127

[45] Aug. 21, 1979

[54] THERAPEUTIC AND REHABILITATIVE CARRIAGE

[75] Inventor: Robert E. Vago, Manlius, N.Y.

[73] Assignee: Diakinetics, Incorporated, East Syracuse, N.Y.

[21] Appl. No.: 857,100

[22] Filed: Dec. 5, 1977

[51] Int. Cl.[2] ..... A47C 1/027

[52] U.S. Cl. ..... 297/345; 280/87.02 R; 297/429

[58] Field of Search ..... 280/47.38, 47.39, 47.4, 280/242 WC, 211, DIG. 4, DIG. 5, 242; 297/45, 345

[56] References Cited

U.S. PATENT DOCUMENTS

| | | | |
|---|---|---|---|
| 2,369,040 | 2/1945 | Grady | 280/242 WC |
| 2,380,160 | 7/1945 | Ficvoh | 280/242 WC |

FOREIGN PATENT DOCUMENTS

| | | | |
|---|---|---|---|
| 8561 | of 1903 | United Kingdom | 280/47.4 |

*Primary Examiner*—Joseph F. Peters, Jr.
*Assistant Examiner*—Norman L. Stack, Jr.
*Attorney, Agent, or Firm*—James Magee, Jr.

[57] ABSTRACT

The specification discloses a wheeled multi functional vehicle or chair for therapeutic and rehabilitative use by invalids and others having muscular and neurological disability. The vehicle is characterized by a frame on which is supported independently adjustable elements including a seat, back support, an activity table, foot support, and associated limb positioning and restraining elements. Also disclosed is a unique locking apparatus for adjustable positioning and attachment of the various elements.

This invention is directed to an apparatus or device for the treatment and normalization of individuals both infant and adult, who are physically handicapped by reason of muscular or neorological trauma. More particularly, it is directed to a multi-positional vehicle of the walker-perambulator type capable of functions essential to the care, normalization and treatment of patients suffering from cerebral palsy and similar conditions. The vehicle of this invention is a personal postural seating apparatus which allows maximum freedon for upper body movement, full support of the lower torso and extremeties, and coordination of hands and arms.

4 Claims, 15 Drawing Figures

THERAPEUTIC AND REHABILITATIVE CARRIAGE

BACKGROUND OF THE INVENTION

Treatment, management, and handling of individuals handicapped by reason of neorological or muscular impairment presents a range of problems extending from the elementary such as merely lifting one's head to the very complex such as the locomotor coordination necessary to feed or draw. Many forms of trauma effect human growth and development and cause disadvantage in bodily functions that make ordinary achievement difficult, if not impossible. Mental retardation, cerebral palsy, muscular dystrophy and brain damage are examples of the traumas which cause the handicap. All of these are characterized by an increased need for postural support in order to prevent advancement of the handicap and the development of resulting degenerative conditions such as spastic extension, deformation of extremities, improper posture development, respiratory impairment, scoliosis and the like.

Many handicapped individuals can be rehabilitated and helped to achieve a degree of self reliance through the use of properly designed supportive apparatus which support the body in the most normal posture possible without undue restraint. One of the largest group of handicapped who can benefit of proper supportive device are those suffering from cerebral palsy and this condition is selected for illustrative description in connection with the instant invention.

The term cerebral palsy includes all of those disorders of the central nervous system resulting from brain damage and characterized by spastic paralysis and impaired motor abilities. It is known that of the large number of cerebral palsy victims, a great majority are infants and young adults. It is also known that of the large number of cerebral palsy victims, a great majority are infants and young adults. It is also known that with proper care and rehabilitative training through physical therapy, persons handicapped by cerebral palsy can be physically improved, often to a degree such that they become largely self-sufficient. Early treatment and rehabilitation is particularly important to the physical and mental development of cerebral palsy victims. In general, the treatment of cerebral palsy involves the use of various types of therapeutic or rehabilitative equipment for the purpose of preventing the development of deformities caused by muscular inadequacy and to enhance the physical development of the patients. Presently available equipment, particularly in the support and locomotion areas, is generally inadequate to satisfy the therapeutic requirements with respect to support of the patient and prevention of the development of deformities. In general, such support is essential in order to correct, as far as possible, existing postural abnormalities and also to prevent continual deterioration of bodily functions as a result of the abnormality. In many instances, the use of proper supportive apparatus can prevent the development of permanent disability or deformity caused by but not directly associated with the muscular or neurological disability itself. For example, respiratory insufficiency or joint dislocation is often the result of an uncorrected postural abnormality which itself may be partially due to inadequate environmental support. Since the range of physical impairment is so wide and the number of associated handicaps so extensive, e.g., vision, hearing, speech, intelligence and emotional levels, supportive equipment for handling and management of such persons must be either custom made or exceptionally versatile.

In the past, the approach most commonly used was to attempt to adapt available equipment such as wheel chairs, walkers, cribs and the like, to the individual needs of the subject. In many cases, this approach actually was nothing more than merely conforming the subject's needs to available equipment.

The need for a therapeutic and supportive device capable of meeting individual postural needs is manifest.

A rehabilitative apparatus of this type serves in a variety of capacities for the purpose of overcoming the lack of muscular ability and resulting deformity. The apparatus should be capable of assisting in the development of postures which approach normal postures and in the development of motor patterns which strengthen a limited range of movement of cerebral palsy victims. The development of useful motor skills is particularly important. By assisting in the development of motor abilities, it is often possible to enable even more severly handicapped patients to develop means of self-expression, independence and in feeding, dressing, and other necessary functions. Through the use of properly designed equipment, it is possible for patients to carry on in the absence of a physical therapist.

A chair or similar apparatus is one of the more common devices used in the treatment and rehabilitation of cerebral palsy victims. Through the use of a correctly designed and adjusted chair which fits the patient, nearly normal head, neck and sitting postures and a wide range of muscular and vocational activity of a therapeutic nature can be achieved. Through the use of suitable accessory equipment, the patient can be exposed to and participate in a variety of manual experiences. When provided with wheels, the patient can be moved from location to location without lifting and carrying. When securely seated in a chair, a patient can amuse himself for long periods of time and thereby develop manipulative skills without reliance upon outside help.

A complete and useful therapeutic chair or vehicle should include back and buttock support means which can be positioned to permit comfortable placement of a somewhat abnormal physical structure. In addition, it is desirable that the chair include a support platform on which the patient's feet may rest. Such a platform should be positioned so that the patient can sit comfortably on the chair with his thighs resting on the seat and the soles of the feet resting flat on the footrest.

In addition, the apparatus should be provided with a table or work surface which fits securely around the patient when seated in the chair or when standing so that manual skills can be encouraged. Such a table should be adjustable to accommodate developing skills and physical growth, and removable to facilitate entry and egress from the chair. Because of the long term aspect of the disease and rehabilitation, the apparatus must be designed for a wide range of adjustments in order to accommodate developing skills and physical growth. Independent adjustability of the various mechanical aspects of the device is particularly important in view of the often abnormal growth patterns characterized by the cerebral palsied.

An object of this invention is to provide an efficient and sturdy vehicle for providing mobility and support for invalids, particularly those having the neurological and muscular dysfunctions which are characteristic of those afflicted with cerebral palsy.

Another object of the invention is to provide a vehicle of the type described, having body supporting features such as seat, back support, foot rest, and activity tray, all of which can be independently adjusted in both horizontal and vertical planes.

Another object of the invention is to provide a postural support apparatus for the correction and treatment of postural abnormalities.

Another object of the invention is to provide a therapeutic device or apparatus for support of the human body in a manner sufficient to prevent development or worsening of postural abnormalities.

A further object of the invention is to provide a wheeled chair capable of providing mobility and body support as well as activity promoting means such as an adjustable work or play table or tray.

Still another object is to provide a vehicle of the type described which provides a safe and convenient place for a person of limited motor and muscular ability.

These and other related objects are provided by a wheeled chair or carriage having an integral frame upon and within which there is provided a seat, back rest, and activity table, together with means for independently adjusting the relative positions of each of the aforementioned members to accommodate individual size and disability characteristics.

GENERAL DESCRIPTION OF THE INVENTION

The apparatus of this invention comprises a wheeled chair or carriage comprising a chassis having horizontal upper and lower frames, upright stanchions between said upper and lower frames, a seat, a back support, foot rest and activity table carried on said chassis by means which are capable of providing independent positioning and both vertical and horizontal movement of the seat, the back support and the foot rest. An important aspect of the invention resides in the means for securing the functional elements, i.e., activity tray, seat, back support and foot support to the chassis in a stable and safe manner but which can be easily released to independently position each of the elements to accommodate variations in the size and posture of the person using the device. In other words, the basic device should be adjustable so it can be fitted to an individual patient and then readjusted to accommodate growth and development of the patient.

The functional elements are individually secured to the chassis by a releasable locking means such as wing nuts and bolts, or preferably the socalled detent locks hereafter described. Each element is adapted to be independently moved upwards and downwards, as well as towards the front and rear of the vehicle. In addition, the individuality of the attachment means provides for tilting of the elements, particularly of the seat and back support. For example, the back support can be raised or lowered independently of the seat and can also be reclined. It can also be moved forward to shorten the seat. The seat can be moved towards the front or rear of the vehicle at any given height and can be raised or lowered independently of the back support. Moreover, the seat can be tilted by raising or lowering the front and rear edge independently of the other or slanted from side to side in a like manner.

DESCRIPTION OF PREFERRED EMBODIMENTS

The invention will be more fully understood when considered in view of the accompanying drawings in which.

The outstanding therapeutic utility of the herein described seating apparatus is derived, in part, from the wide range of postural flexibility resulting from the independent adjustability of the various functional elements of the apparatus. For example, the seat which is designed to receive and support the patient's buttocks can be moved up or down on the supporting stanchions. It can also be tilted, or moved angularly from front to back or side-ways. The back support can be adjusted, independently of the seat, in a vertical plane and tilted backwards or forwards. The foot support can also be moved independently of the seat and back rest horizontally, vertically and angularly.

Figure 1:
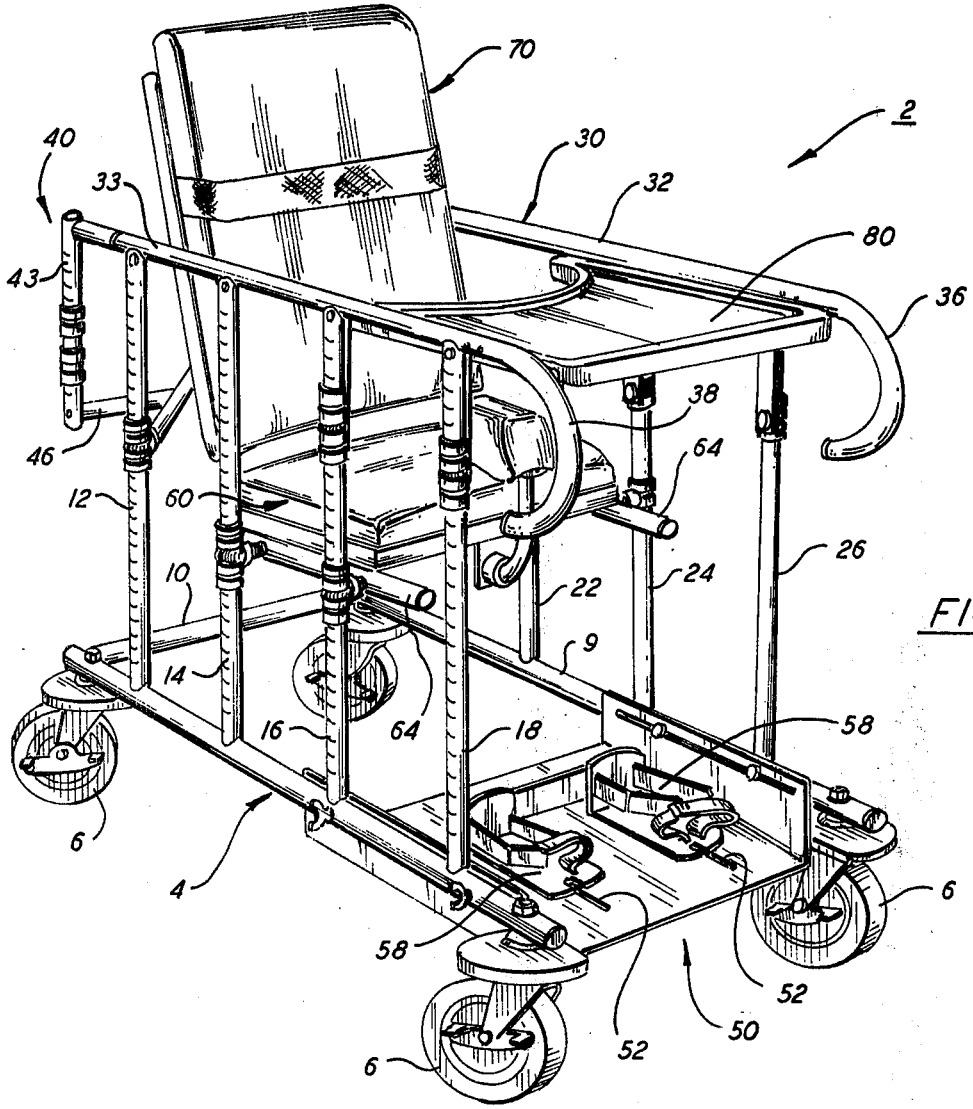
FIG. 1 is a perspective view of the apparatus of the invention.

Referring now to FIG. 1, an illustrative and preferred embodiment of the invention is shown as comprising a chassis or frame and various independently adjustable elements including an activity tray, a seat member, a back support member, and a foot supporting member operatively associated with and carried upon the chassis. Numeral 2 generally indicates the therapeutic and rehabilitative vehicle having the characteristics of the invention. The chassis of the chair is constructed of tubular stock and has a basic frame design comprising a lower frame unit 4 made up of a pair of horizontal side bars 8 and 9 and a connecting rear horizontal bar 10. The front of the lower frame unit 4 is open in order to facilitate placement of the patient and attachment of various items of auxiliary equipment, such as the foot support 50 hereafter mentioned.

Figure 10:
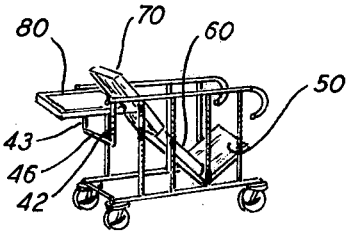
Figure 11:
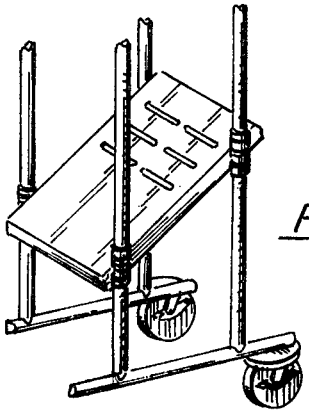
FIG. 11 is a perspective view of the foot rest in position.
Figure 12:
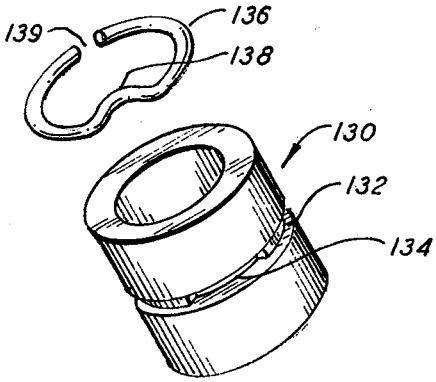
FIG. 12 is a perspective of the locking means used to secure various functional elements of the vehicle.

Extending upwardly from the side bar 9 of the lower frame unit are a plurality of upright stanchions numbered 12, 14, 16, 18, 20 (not visible), 22, 24, and 26. These stanchions support a horizontal upper frame unit, shown generally at numeral 30, are of tubular construction, and are provided with a series of spaced horizontal slots on the outer side thereof. The upper frame unit shown generally as 30 consists of a pair of parallel side bars 32 and 33 which match the horizontal sidebars of the lower frame unit 4 and also an adjustable handle member shown generally at 40. The forward ends of side bars 32 and 33 are provided with downwardly curving portions 36 and 38. The handle member 40 comprises a pair of vertical extensions 42 and 43 (see FIGS. 5 and 6) and a cross bar 46. The handle member 40 is advantageously designed for removable attachment to the upper frame unit 30 by suitable means such as a telescope connection held in place by knurled screws and nuts. The handle 40 can be removed and reversed so that the vertical extensions 42 and 43 project upwardly from side bars 32 and 33 to form, with member 46, a handle for pushing the vehicle. When the handle 40 is in the lower position, back rest 70 can be reclined to provide the semi-standing position of the foot rest 50, as illustrated in FIG. 10.

The vertical extensions 42 and 43 of handle 40 and the stanchions of frame 4, all of which are of tubular configuration, are provided with horizontal slots spaced from each other and extending substantially from top to bottom thereof. The size of the slot is designed to cooperatively receive a detent means, hereafter described, which forms part of the locking means, also described hereafter, and being in length a segment of the diameter of the tube. The configuration of the slots is more particularly shown in FIG. 13 at numerals 13*a*, 13*b*, etc. Each of the aforementioned tubular upright members, i.e., 14 through 18, and the like, is provided with a plurality of locking devices, preferably of the type described in FIGS. 12 through 15. These devices comprise a pair of lockable detent rings and a slideable collar with arm positioned between said detent rings. The locking means are designed and adapted to cooperate with the horizontal slots in the tubular upright stanchions as will be hereafter described, to provide for positional adjustment and attachment of functional elements of the vehicle such as seat 60, backrest 70 and footrest 50, and activity tray 80.

Figure 2:
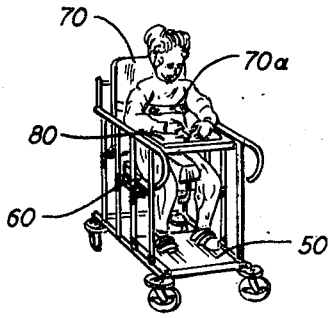
FIGS. 2, 3 and 4 are perspective views showing various operational configurations of the vehicle.

As shown in FIG. 1, the chair is provided with a foot support 50 which can be removed from the vehicle to allow use as a walker, or positionally adjusted to accommodate users of varying size and needs through periods of growth and development. It is located at the front of the lower frame unit 4 so it can be positioned to fit a particular individual user. As shown, the foot support 50 is provided with a plurality positionally adjustable foot restrainers 58 which, by means of slots 52, can be individually positioned to receive and secure the feet of a patient. Either a single slot extending from front-to-back as seen in FIG. 2 or a series of successive cross-slots, as in FIG. 10, can be used to provide adjustability. A wing nut and bolt or other suitable means can be used to provide attachment of the restrainer to the foot rest. Foot rest 50 is removably attached to the horizontal side bars 8 and 9 of the lower unit by suitable means such as bolts and wing nuts, as illustrated in FIG. 1, or by the locking means shown in FIG. 15, can be reclined to provide the semi-standing position illustrated by FIG. 10.

In addition to the foot support 50, the vehicle is provided with seat 60, back support 70 and activity tray 80, all of which are carried on selected upright stanchions. These functionals elements of the vehicle are more fully described hereafter.

In describing the accompanying drawings, reference has been and will be made to a locking device for the purpose of describing means for attaching to the vehicle various elements, e.g., seat, tray, foot rest, back support, and the like. Such attachment must permit positional adjustability and secure locking in a selected position. Since many types of locking means can be devised and utilized to accomplish this dual function, the broad term locking means as used herein refers to any suitable means for providing stable attachment of the movable elements of the herein described vehicle. A preform of locking means is shown in place in these drawings and is described in detail in FIGS. 12 through 15.

Figure 14:
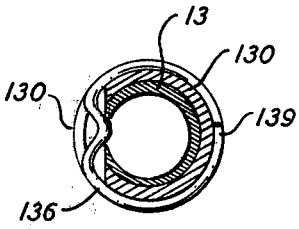
FIG. 14 is a horizontal section taken along line 14—14 of FIG. 13.
Figure 15:
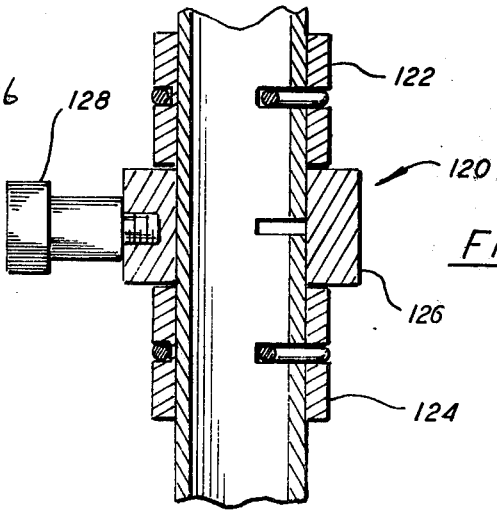
FIG. 15 is a sectional view showing cooperation of locking means in the support of functional elements of the vehicle.

As shown in the drawings, each of the upright stancions is provided with a plurality of locking means of the type shown in FIG. 15. For purposes of identification, these locking means are designed by the number assigned to the stanchion and a subscript-letter beginning with the upper locking means which is designated 1, the next down being designated 2, and so on. A description of the operation of the locking means of FIG. 12–15 will make the operation of the vehicle and the cooperation of its elements more clear.

Figure 5:
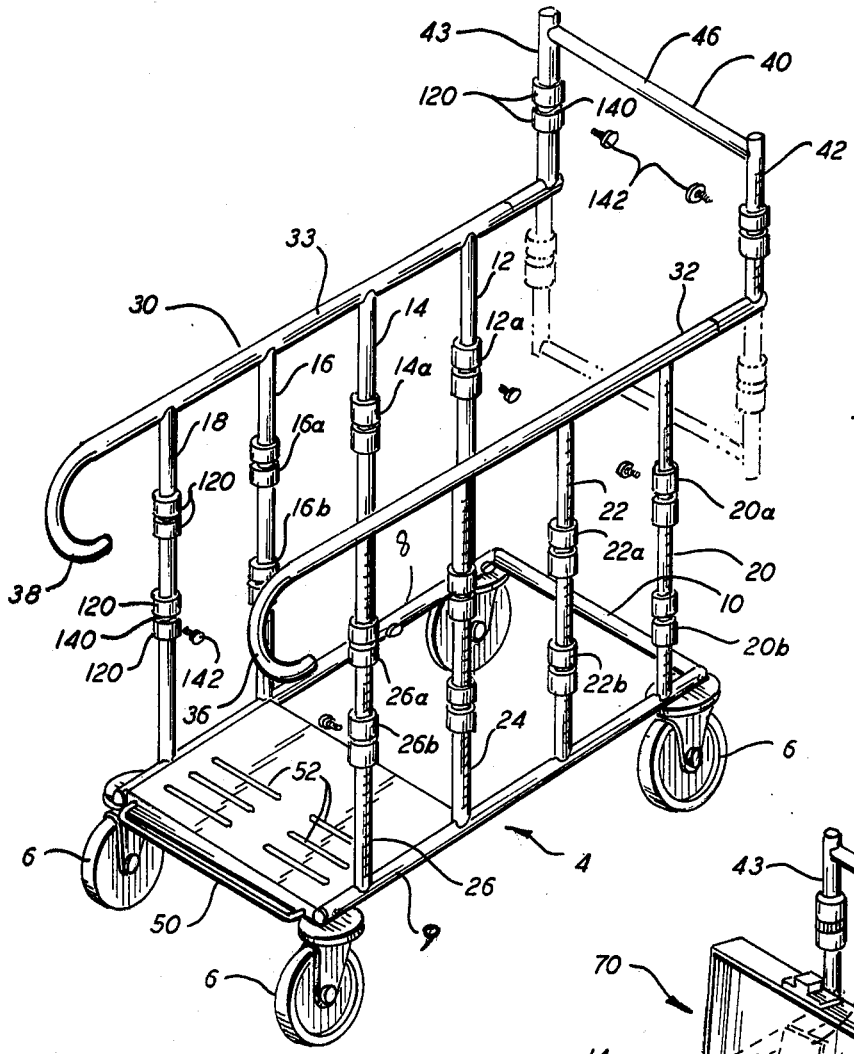
FIG. 5 is a perspective view of the framework of the vehicle of the invention.

Referring now to FIG. 15, there is shown locking means 120 comprising upper and lower detent collars 122 and 124 respectively and a freely movable or slideable arm-carrying collar 126, positioned between the upper and lower detent collars 122 and 124. Extending outwardly from collar 126 is arm 128, e.g., a shoulder bolt which, as shown, is threaded into a tapped hole in collar 126. In FIG. 5 for purposes of illustration, a pair of respresentative arms are shown adjacent to the upper locking means of stanchions 12 and 20. The locking means are to be understood as having such supportive arms. The configuration of detent collars 122 and 124 are shown in more detail in FIG. 12 as comprising a cylindrical structure 130 which for purposes of description is numbered 130 but corresponds to collars 122 and 124 of FIG. 15. Cylinder 130 has a hollow core adapted to fit over and slide upon a tubular member such as the upright stanchions of FIG. 1. Cylinder 13 is provided with an annular groove 132 at the approximate middle thereof. At one point, shown at 134, groove 132 is cut through to form a slot or orifice 134 communicating with the hollow core of cylinder 130. Ring 136, suitably formed of spring steel, having point 138 and an open portion 139 is shaped to fit within groove 132 so that point 138 passes through slot 134 and projects into the core of cylinder 130. Ring 136 is also designed to be rotatable in groove 132 so that point 138 can be forced out of slot 134.

Figure 13:
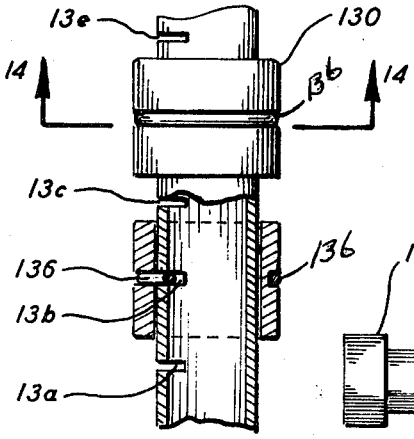
FIG. 13 is a view partially in perspective and partially in section of the locking means.

Referring now to FIGS. 13 and 14, two views of a detent collar are in place of a slotted tubular shaft such as is used to form stanchions 12, 14, 16, etc., or extensions 42 and 43. For purposes of the description of this particular figure, the lower detent collar shown in vertical section is numbered 130, the tubular shaft is numbered 13, and the slots in the shaft are numbered 13*a*, 13*b*, 13*c*, and 13*e*, slot 13*d* being concealed from view by the upper detent collar 130 shown in perspective. Protrusion of the point 138 of ring 136 througn slot 134 of the detent ring and into a slot in the tubular member is shown in more detail in FIGS. 13 and 14. As point 138 engages one of the slots in the stanchion, such as 13*b* of FIG. 13, it locks the detent ring onto the stanchion and prevents movement up and down the stanchion. Rotation of the detent collar around the stanchion is possible and such rotation is the mechanism for disengaging point 138 from the slot 134 of the detent collar and 13*b* of the stanchion, thus permitting vertical repositioning of the detent ring while point 138 bears on the outer surface at one side or the other of the slot therein.

Referring once again to the vehicle as a whole, the basic structure, of the chassis of the vehicle, without functional elements, is shown in FIG. 5. Lower frame unit 4 is supported by wheels 6 attached at the corners of said lower frame unit. The lower frame unit consists of side bars 8 and 9 and rear bar 10. Extending upwardly from the lower frame unit and connecting with the upper frame 30 are stanchions 12, 14, 16, 18, 20, 22, 24, and 26. Handle 40, consisting of side bars 42 and 43 and cross bar 46, is attached to the straight ends of bars 32 and 32*a*. The forward ends of the side bars 32 and 33 are downwardly curved as shown at 36 and 38. Foot rest 50, having slots 52 therein, is shown in position attached to the forward portion of the lower frame unit 4. Each of the upright stanchions and the side bars 42 and 43 are provided with a plurality of locking devices 26*a*, 26*b*, etc., as mentioned above.

Figure 7:
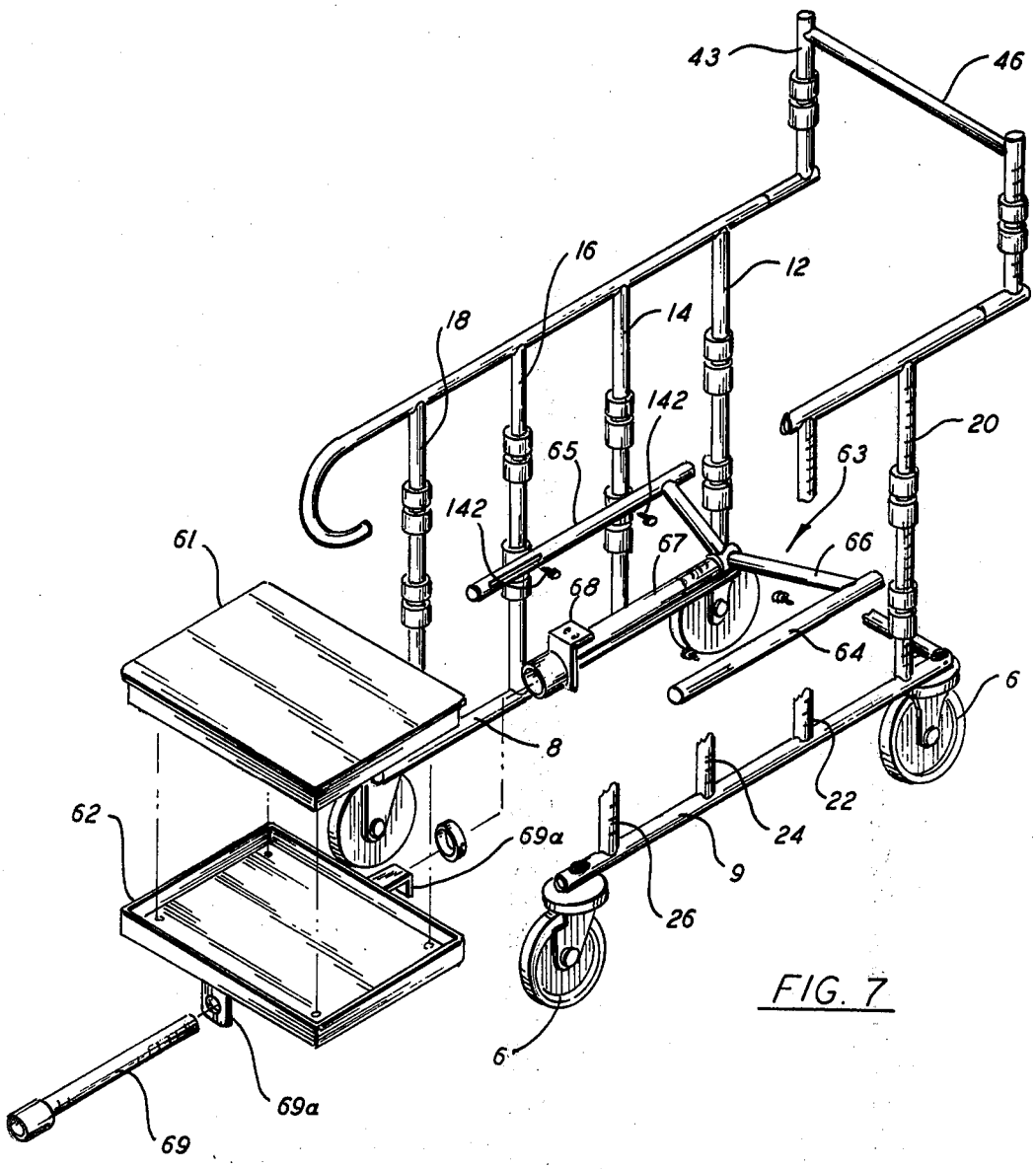
FIGS. 7, 8, 9 and 10 are perspective views of various functional configurations.
Figure 9:
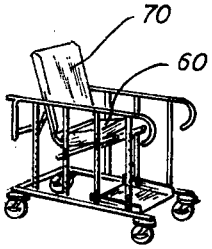

FIG. 7 shows the vehicle of this invention in a partially disassembled view arranged as a carriage for pushing handle 40, being upright and having an adjustable seat, corresponding to 60 of FIG. 1. Seat 60 is both horizontally and vertically adjustable and comprises a cushion 61 which fits into frame 62. The combination of frame and cushion is carried upon a seat support shown generally as 63. The seat support 63 consists of a pair of side bars 64 and 65 and a back bar identified by numeral 66. Seat support 63 is adjustably secured to stanchions 12, 14, 16, 22, 24, and 26 by locking means located on stanchions 14, 16, 22, and 24 as described above. Because of the independent suspension of all four corners of the seat support 63 the seat itself can be tilted frontwards, backwards, or sidewards. Extending forwardly from the back bar is a tubular member 67 upon which is fixed an "L" shaped bracket 68. Tube 66 is adapted to receive shaft 69 in sliding engagement. Shaft 67 which is provided with spaced slots in the same manner as are the upright stanchions and similar elements of the basic frame. The slots of shaft 69 are designed and adapted to engage and be secured by a locking device, of the type illustrated in FIG. 12, located on the remote end of tube 67. Shaft 69 is designed to pass through bracket 69 on the seat frame 62, thence into tube 67, thus securing the seat frame 62 to the seat support 63. In operation, the seat 60 is moved from front to back within the chassis by releasing the locking means on the rear of tube 67 as described above in regard to FIG. 12 and then sliding shaft 69 within tube 67 until the proper position is achieved and then securing the seat in that position by means of the locking device. Vertical positioning of the seat 60 is achieved by suitable adjustment of support 63 by the locking means on stanchions 14, 16, 22, and 24. As shown, the support arm 128 of each of the locking means used to secure the seat 60 pass through orifices provided in side bars 64 and 65, which are necessary to accommodate upwards tilting of the seat as illustrated in FIG. 9.

Figure 6:
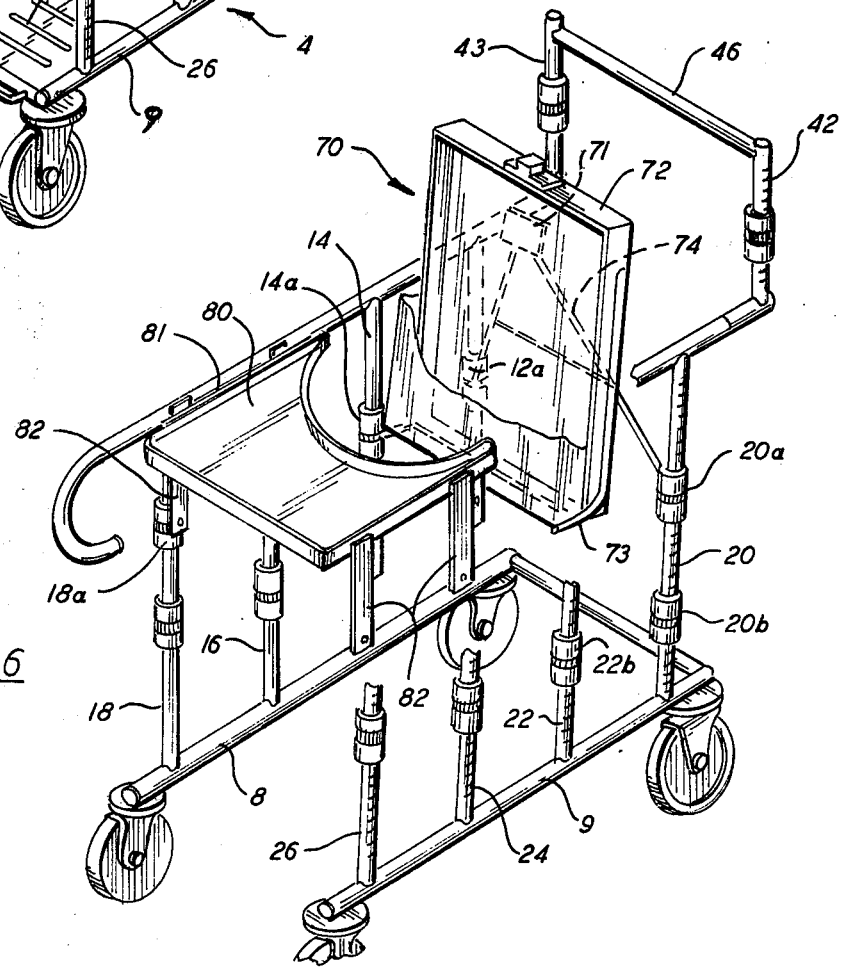
FIG. 6 is a partial perspective view of the vehicle with back rest and activity tray in operational position.

In FIG. 6, the chair is shown with activity tray 80 in place. The tray provides a stable play or work surface which can be positioned to accommodate a wide range of activities by patients of varying size and capabilities. Preferably, the tray is provided, as shown, with a rim 81 to contain and prevent loss of utensils, toys, tools, crayons, and the like. The tray is provided with a cut out portion to partially encircle the upper torso of the patient and is removably mounted on the chassis 4 by means of four brackets numbered 82, which in turn are secured to stanchions 16, 18, 24 and 26 by locking means 16*a*, 18*a*, 24*a*, and 26*a* as described above. It is often desirable that the tray be adapted to swing up and away from the patients by means of suitable hinges and clips of known construction.

Referring still to FIG. 6, the chair is also provided with a back support, shown generally at 70. The back support 80 comprises a cushion or pad, not shown in FIG. 6 but visible in FIG. 1, and a box-like frame 72 adapted to receive and hold the cushion. At its lower end, the frame 72 is movably attached to stanchions 14 and 22 by a pair of angle brackets 73 and suitable locking means as illustrated at 14*a* and including 22*a*. The upper portion of back support 70 is secured by bracket 71 and an A'frame fixture 74. The lower end of each leg of fixture is slidably secured to stanchions 12 and 20 by means of locking devices 12*a* and 20*a*, the support art of which passes through an opening or hole in the lower end of each leg of fixture 74. The relative said positioning of locking means permits tilting of back support 70 to a reclining position. If desired the back support can be fitted with an adjustable head rest to receive and support the head and neck of a patient. Such a support can be secured on the top of the back support by known means.

The wide range of operative configurations in which the vehicle of this invention can be utilized are illustrated by FIGS. 2, 3, 4, 8, 9, and 10.

In FIG. 2, the chair is shown with patient in place supported by foot rest 50, seat 60, back rest 70 and using activity tray 80. Additional support for the upper torso is provided by a body band 70*a* or belt which passes around the body of the patient.

Figure 3:
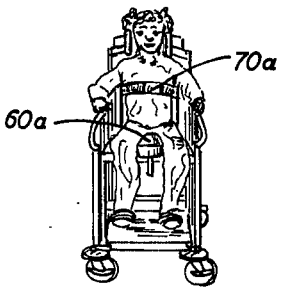

In FIG. 3, the activity tray has been removed to show placement of an abduction unit or pommel 60*a* between the thighs of the patient. Such units are well known in the treatment of muscular and nervous system disorders and can be attached to seat 60 by known means.

Figure 4:
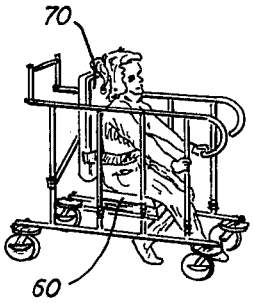

In FIG. 4, the foot rest 50 has been removed. Seat 60 and back support 70 are lowered to permit the patient's feet to contact ground or floor. This permits use of the chair as a sitting walker.

Figure 8:
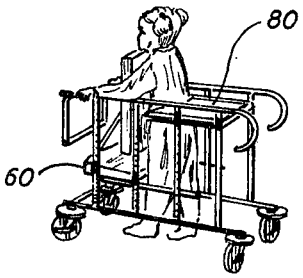

In FIG. 8, use as a stand-up walker with a patient facing the rear of the chair is illustrated. Tray 80 and back support 70 are positioned to provide support for the patient while seat 60 is in a non-use position. The patient could be faced in the opposite direction. In FIG. 9, the back support 70 and seat 60 are tilted into a semi-reclining position. Suitable adjustments of these elements makes possible a wide variety of positions, from sitting to almost supine.

In FIG. 10 seat 60, back support 70, and foot rest 50 cooperate to provide a so-called standing-borad configuration in which these elements support the patient in an extended semi-prone or sloped posture. The patient is placed on the stomach facing the rear of the chair and the activity tray 80 is positioned as shown to provide a work or play surface. In this configuration, the handle 40 comprising sides 42 and 43 and cross piece 46 must be placed in the down position as described above in order to accommodate the slant of back support 70 and the position of tray 80.

What is claimed is:

1. A therapeutic and rehabilitative carriage for receiving and transporting an invalided patient comprising a wheeled chassis having horizontal upper and lower framework and a plurality of upright stanchions running between the upper and lower framework to provide a generally cage like structure, a seat member for receiving and supporting the buttocks of a patient mounted on selected stanchions for horizontal, vertical, and angular movement; a back support member mounted independently of the seat member and positionable with respect to said seat in order to receive and support the back of said patient; a foot rest platform mounted on the lower frame work below the seat member to receive and support the feet of said patient; said seat member, back support member, and foot rest platform being independently positionable within said chassis; and movable locking means on said stanchions vertically positionable to secure in selected relative positions said seat member, back rest member, and foot rest platform.

2. A carriage, as described in claim 1 wherein the chassis comprises upper and lower frame units disposed horizontally with a plurality of vertical upright stanchions running between the upper and lower frame units disposed along the sides thereof, a handle for pushing and controlling the carriage detachably mounted on the upper frame unit, a plurality of wheels, for ground movement in supportive association with said chassis; a seat member being movably mounted within the chassis on selected stanchions for vertical, horizontal, and angular positioning to receive and support the buttocks of a patient; the back rest member being movably mounted on selected stanchions within the chassis in cooperative relationship to said seat member and independently positionable vertically, horizontally, and angularly with respect thereto to receive and support the back of said patient; the foot rest platform being movably mounted in the lower frame unit below and forward of the seat member to receive and support the feet of said patient in relation to the posture of said patient; said movable backing means being slidably associated with the stanchions for cooperation with the seat member, back rest member and foot rest platform to permit independent positioning of said member with respect to postural characteristics of said patient.

3. The carriage of claim 2 wherein said seat member comprises a support element slidably mounted for horizontal movement on a frame said frame being cooperatively attached to a plurality of independently vertically movable locking means associated with selected stanchions; said back support member consisting of a back support element and mounting element positionally mounted on selected stanchions by locking means slidably associated with said stanchions.

4. A vehicle as defined in claim 3 wherein said locking means comprises an upper and lower detent member and a support member positioned therebetween said locking means engaging portions of the chassis is releasable attachment.

* * * * *